US006328317B1

(12) United States Patent
Benoit

(10) Patent No.: US 6,328,317 B1
(45) Date of Patent: Dec. 11, 2001

(54) ARTICLE OF GLIDING EQUIPMENT, SUCH AS AN IN-LINE ROLLER SKATE, HAVING A HOLLOW BODY FRAME

(75) Inventor: Louis Benoit, La Balme de Sillingy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/029,070

(22) PCT Filed: Jun. 19, 1997

(86) PCT No.: PCT/FR97/01100

§ 371 Date: Mar. 2, 1998

§ 102(e) Date: Mar. 2, 1998

(87) PCT Pub. No.: WO98/02217

PCT Pub. Date: Jan. 22, 1998

(30) Foreign Application Priority Data

Jul. 12, 1996 (FR) ..... 96 09056

(51) Int. Cl.[7] ..... A63C 17/04

(52) U.S. Cl. ..... 280/11.221; 280/11.18; 280/11.27

(58) Field of Search ..... 280/7.12, 7.13, 280/841, 11.19, 11.27, 11.12, 600, 11.18, 11.221, 11.223, 11.224, 11.231, 11.233

(56) References Cited

U.S. PATENT DOCUMENTS

| | | | | |
|---|---|---|---|---|
| 2,168,820 | * | 8/1939 | Edstrom | 280/11.23 |
| 3,351,353 | * | 11/1967 | Weitzner | 280/7.13 |
| 3,934,892 | * | 1/1976 | Baikie | 280/11.12 |
| 4,088,335 | * | 5/1978 | Norton et al. | 280/11.18 |
| 4,088,336 | * | 5/1978 | Chapel | 280/11.19 |
| 5,531,462 | | 7/1996 | Gu | 280/7.13 |
| 5,662,338 | * | 9/1997 | Steinhauser, Jr. | 280/11.27 |
| 5,882,018 | * | 3/1999 | Petrosino | 280/7.13 |

FOREIGN PATENT DOCUMENTS

| | | | | |
|---|---|---|---|---|
| 634068 | * | 1/1962 | (CA) | 280/11.18 |
| 2446210 | | 4/1975 | (DE) . | |
| 0321026 | | 6/1989 | (EP) . | |
| 2613950 | | 10/1988 | (FR) . | |
| 334782 | | 9/1930 | (GB) . | |
| 400436 | * | 10/1933 | (GB) | 280/11.22 |
| 4-297284 | * | 10/1992 | (JP) | 280/11.18 |
| 87/05818 | * | 10/1987 | (WO) | 280/11.22 |

* cited by examiner

*Primary Examiner*—Frank Vanaman
(74) *Attorney, Agent, or Firm*—Greenblum & Bernstein P.L.C.

(57) ABSTRACT

An article of gliding equipment, such as for practicing ice skating or hard surface skating, of the type that includes a frame defined by two lateral flanges on which are attached the gliding member or members, such as a gliding blade or wheels, and the upper plate adapted to be made integral with the external sole of the skater's boot. The frame is formed as a hollow body, hermetically closed in both the transverse and longitudinal directions, simultaneously defining the lateral flanges, the upper plate, and the end parts.

14 Claims, 3 Drawing Sheets

ARTICLE OF GLIDING EQUIPMENT, SUCH AS AN IN-LINE ROLLER SKATE, HAVING A HOLLOW BODY FRAME

BACKGROUND OF THE INVENTION

1. Field of the Invention

The instant invention is related to a gliding equipment, in particular for practicing ice skating or hard surface skating, of the type constituted of a frame defined by lower lateral flanges on which the gliding member or members are attached, depending on whether it is a blade for skating on ice, or wheels for skating on a hard surface, and an upper plate intended to be integral with the external sole of a skater's boot.

The invention is more specifically related to a frame for this type of skate, intended to provide a connection between the gliding members, such as a blade or wheels, and the user's foot, or more precisely his boot, the frame being interposed therebetween.

2. Description of Background and Relevant Information

Frames of the aforementioned type have to exhibit substantial mechanical resistance characteristics, while also remaining as light as possible so as not to occasion too much effort on the part of the athlete.

It has been known to manufacture such frames by molding synthetic materials that offer the advantage of enabling one to obtain a fair variety of shapes.

As a result, these frames are generally made by injection, generally by using a polyamide reinforced with glass fibers, and they are made either all in one piece or in two parts.

However, in order that these frames fulfill the minimum stiffness requirements necessary for the satisfactory functioning of the skate, the ratio of fibers must be on the order of 30%, and in addition, in order to improve stiffness, they must have several reinforcement ribs.

However, the cost of production of such an equipment is, in fact, a precise function of the price of the materials, and especially the ratio of fibers together with the number of ribs required, which complicates the molding process.

In addition, the fact that this type of frame is open at its lower portion constitutes a trap for dust and other dirt, such as mud, for example, when rain mixes with dust.

The aforementioned disadvantage is all the more bothersome because ribs are present at the lower portion of the frame, and they too constitute nooks and crannies that are apt to accumulate said dirt.

SUMMARY OF THE INVENTION

It is the aim of the instant invention to overcome these disadvantages by suggesting an improved frame enabling the aforementioned disadvantages to be overcome, and also retaining all its stiffness whilst requiring a smaller ratio of fibers, and doing away with all the reinforcement ribs in its lower portion.

To this end, the invention is related to a gliding equipment, in particular for practicing ice skating or hard surface skating, of the type constituted by a frame defined by lateral flanges on which are attached the gliding member or members, such as a blade or wheels, and an upper plate intended to be integral with the external sole of a boot, wherein the frame is constituted by a hollow body that is hermetically closed, both in the transverse as well as in the longitudinal directions, simultaneously defining the lateral flanges, the upper plate and the end parts. Such a construction enables the elimination of the reinforcement ribs, without any loss of stiffness, nor any increase in weight, due to the rigid one-piece and self-supporting structure obtained in this manner.

The instant invention is also related to the characteristics that will become apparent from the description that follows, and these should be considered either singly or as per all possible technical combinations thereof.

BRIEF DESCRIPTION OF THE DRAWINGS

This description, which is provided as a non-restrictive example, will provide a better understanding of how the invention can be obtained, with reference to the annexed drawings wherein.

DETAILED DESCRIPTION OF THE INVENTION

Figure 6:
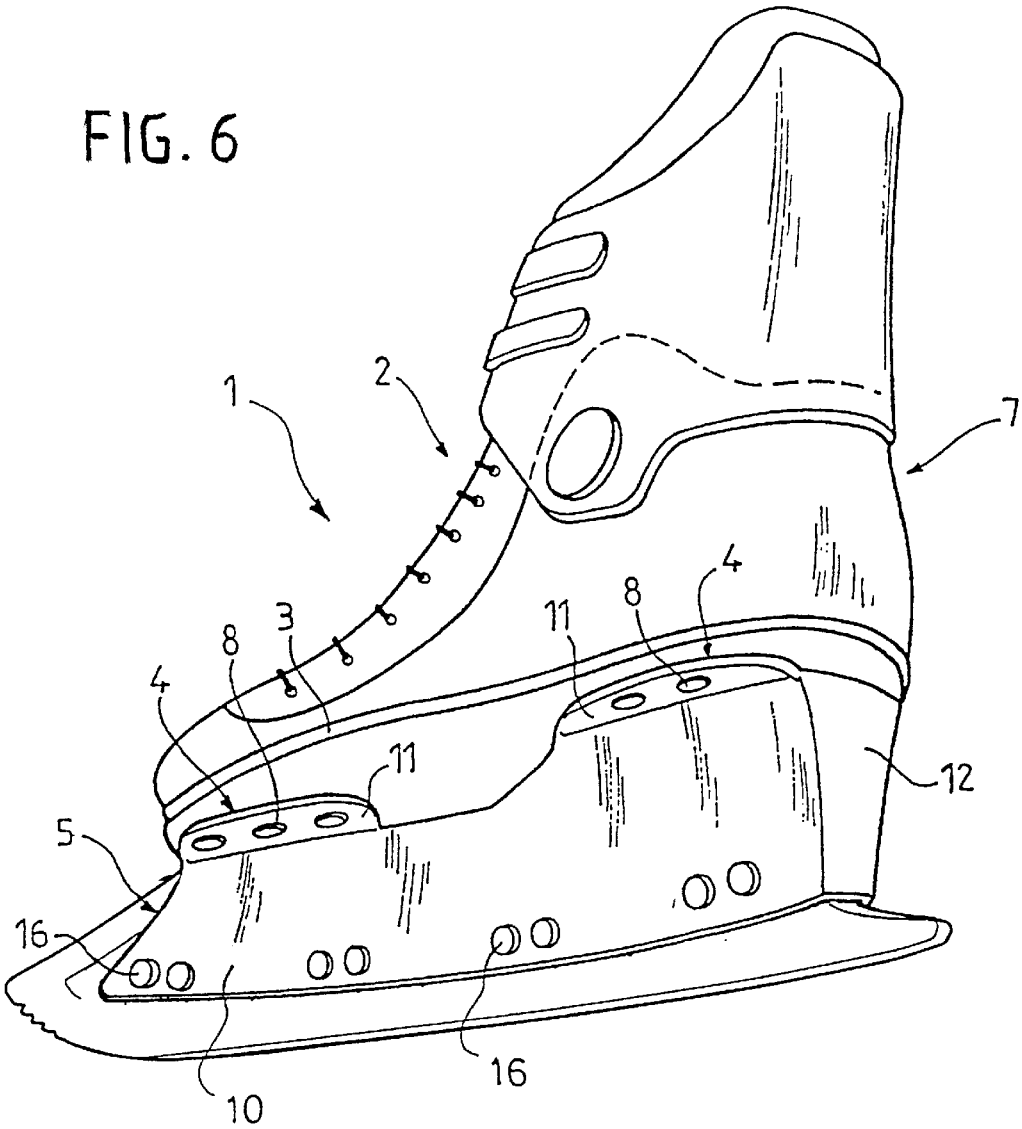
FIG. 6 is a perspective view of an article of gliding equipment, like that of FIG. 1, but represents an ice skate rather than an in-line roller skate.

In order to illustrate the invention, a description of an in-line roller skate constituting one embodiment thereof will be provided. FIGS. 1–4 depict such roller skate. It is to be understood naturally that a frame as per the invention can be adapted to any other type of gliding equipment. FIG. 6 depicts an ice skate.

Figure 1:
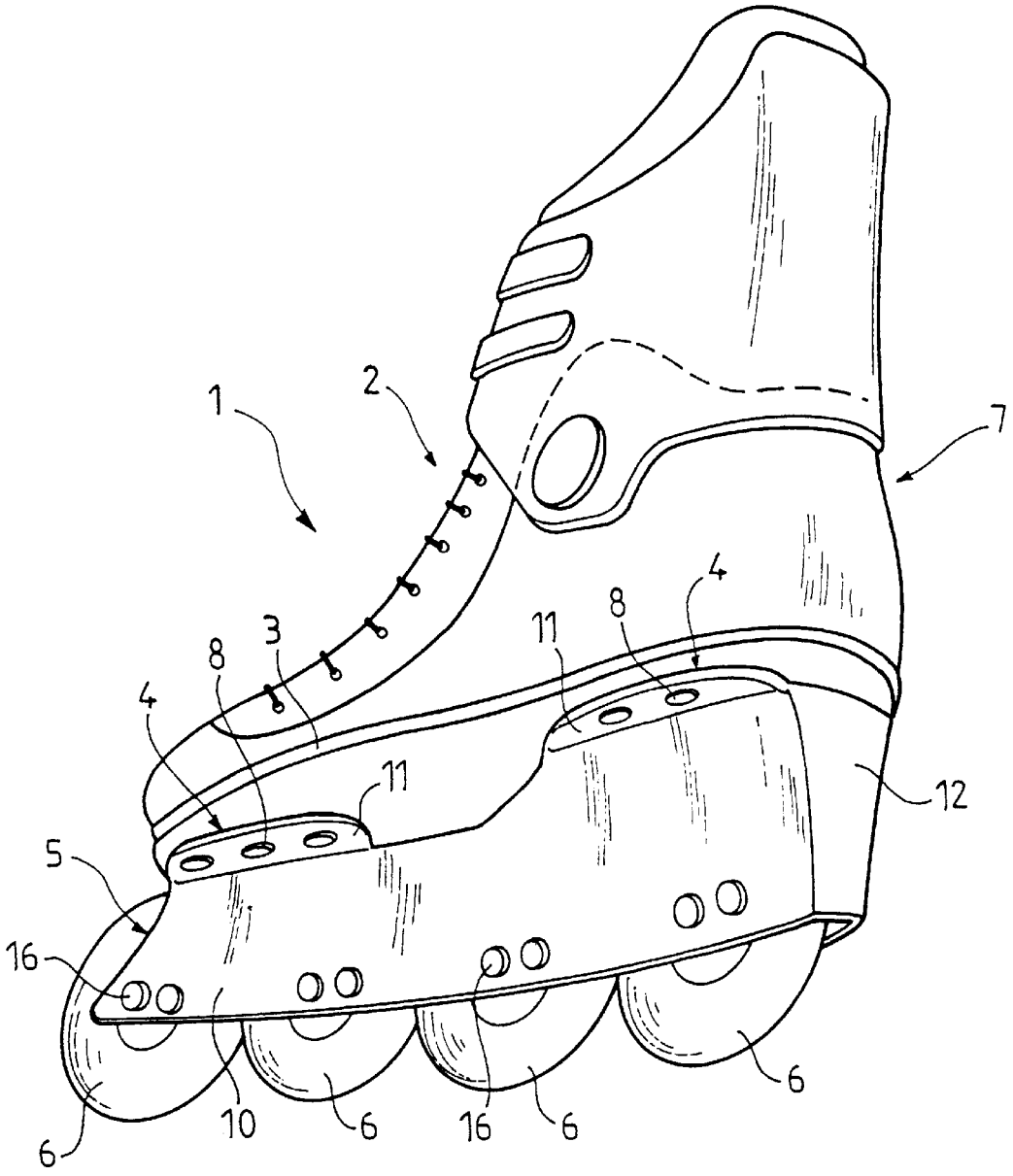
FIG. 1 is a perspective view of a gliding equipment, in this case, an in-line roller skate, and a boot associated thereto, obtained on the basis of a frame according to the invention.

The in-line roller skate 1, designated in its entirety and represented in FIG. 1, thus comprises a boot 2 constituted of an external sole 3 intended to be integral with the upper plate 4 of a frame 5 along which the wheels 6 are arranged, a sole 3 from which an upper 7 is extended covering the entire foot and extending in the direction of the skater's ankle. FIG. 6 is identical to FIG. 1, except that the wheels of FIG. 1 are replaced with an ice skating blade.

The sole 3 of boot 2 is rendered integral with the frame 5 forming the upper horizontal plate 4 on which the sole 3 is affixed, via the intermediary of affixing means, in this case, screws 8 that cross the plate 4 in order to be screwed into the lateral edges of sole 3.

The frame 5 also comprises a lower portion that is overall perpendicular to the plate 4 along its longitudinal axis, constituted by the lateral flanges 10 extending longitudinally along either side of the longitudinal axis of the skate, the wheels 6 being attached to the flanges 10.

The lateral flanges 10 respectively are extended at their upper portions by perpendicular returns 11, each of them being directed outwardly and enabling the affixing of the frame on the sole 3 of the boot by means of screws 8. According to the boot/frame affixing method provided here, the perpendicular returns 11 could be eliminated, and the boot could thus be affixed directly on to the plate 4.

Figure 3:
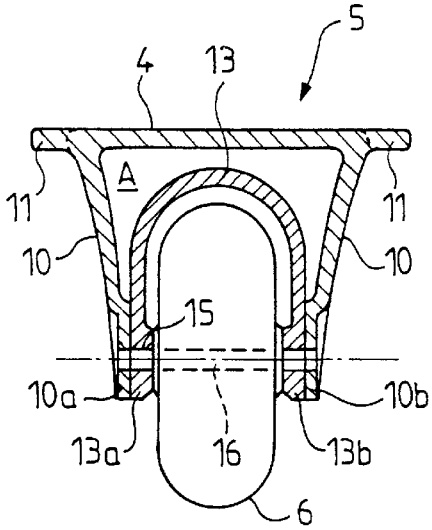
FIG. 3 is a transverse sectional view along the line III—III of FIG. 2.

According to the invention, the frame 5 is constituted, as is clearly visible in FIG. 3, by a hollow body A which is hermetically closed both in the transverse as well in the longitudinal directions, and simultaneously defines the lateral flanges 10, the upper plate 4 as well as the end closure parts 12.

According to another characteristic of the invention, the hollow body A defining the frame 5 is closed at its lower portion by an external longitudinal envelope 13 intended to partially integrate the gliding member or members, in this case the wheels 6.

This external longitudinal envelope 13 in fact acts as a mud guard, and at the same time provides an imperviousness to the inner volume of the hollow body A at the lower portion thereof.

Indeed, the external longitudinal envelope 13 of the gliding member or members, in this case, the wheels 6, is inscribed within the section defined by the lateral flanges 10 and the upper plate 4 forming the frame 5.

Figure 2:
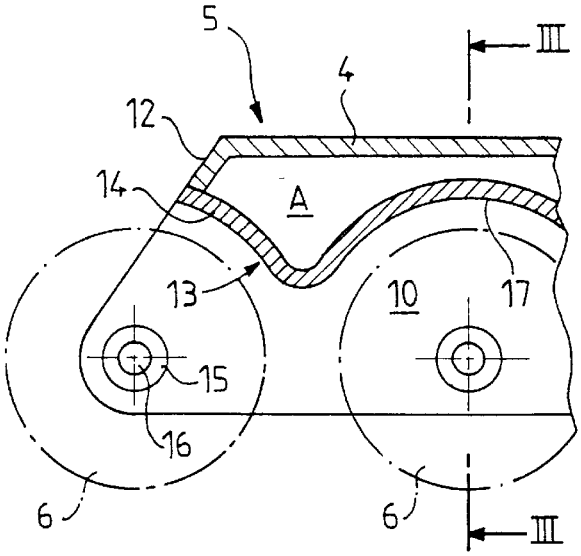
FIG. 2 is a partial, sectional, longitudinal view of a frame as per the invention.
Figure 4:
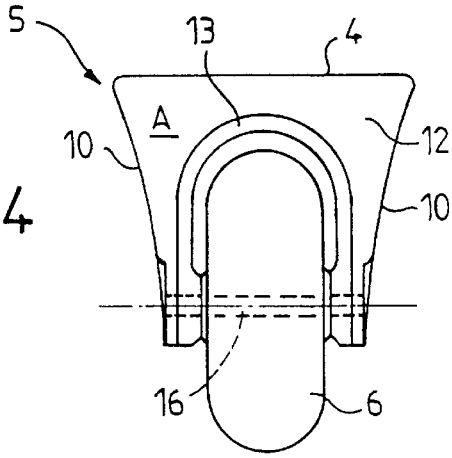
FIG. 4 is an end view of the frame as per FIG. 2.
Figure 5:
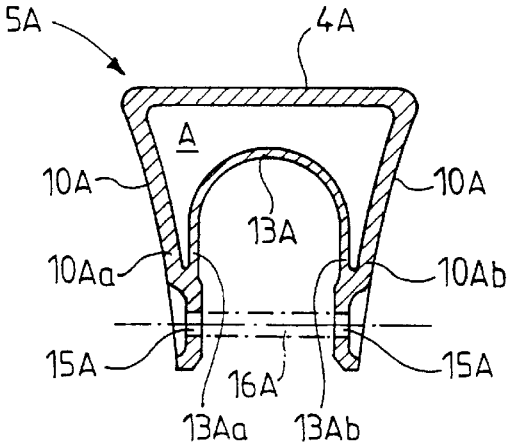
FIG. 5 is a transverse sectional view of a frame as per a second embodiment.

Generally speaking, as is the case in the embodiment of FIGS. 2 through 4, and the variation of FIG. 5, the external longitudinal envelope 13, 13A, a transverse section in the form of an arch whose free lateral ends 13*a*, 13*b*, respectively 13A*a*, 13A*b*, are aligned with the free ends 10*a*, 10*b*, 10A*a*, 10A*b* of the lateral flanges 10, 10A of the frame 5, 5A.

More specifically, according to the embodiment of FIGS. 2, 3 and 4, the external longitudinal envelope 13 is attached by nesting within the structure of the hollow body A defined by the lateral flanges 10, the upper plate 4 and the end parts 12.

This solution has the advantage of being able to use two different materials, and thus enables a choice to be made according to the predetermined stiffness criteria.

The assembly of the longitudinal envelope 13 with respect to the lateral flanges 10 is undertaken by adhesion, ultrasound welding etc.

In the embodiment example of FIG. 5, the frame 5A essentially differs from the previous embodiment in that the external longitudinal envelope 13A is obtained materially with the lateral flanges 10A, the upper plate 4A and the end parts, so as to form a one-piece assembly.

According to this example, the frame 5A is thus made of a single material, and obtained for example, by an extrusion-blow molding method.

In the example represented in FIG. 2, on the contrary, the closure of the ends of the hollow body A forming the frame 5, 5A is obtained at its ends, respectively by two front and rear hanging edges 12 of the plate 4, 4A, against which the corresponding end zones 14 of the upper, vaulted part of the longitudinal envelope 13, 13A take support.

As far as an in-line roller skate is concerned, the bearings 15, 15A intended for the rotational axes 16, 16A thereof are arranged at the free lower ends of the lateral flanges 10, 10A of the frame 5, 5A, and/or the longitudinal envelope 13, 13A.

Still in the context of an in-line roller skate, the upper portion of the longitudinal envelope 13, 13A forming the vault defines longitudinally successive arches 17 corresponding to the passage of the wheels 6. In transverse cross section, the arches have an inverted U-shape, as shown, e.g., in FIGS. 3 and 5.

Figure 7:
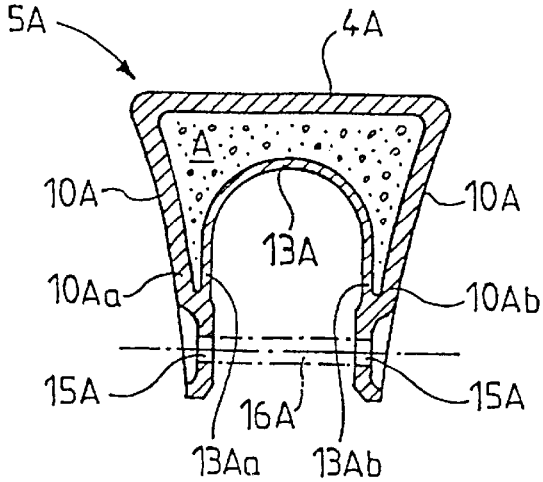
FIG. 7 is a transverse sectional view of the frame of FIG. 5 filled with a foam.

According to another characteristic of the invention which is adaptable to both the embodiments described previously, the hollow body A formed by the frame 5, 5A can be filled with a synthetic foam as shown in FIG. 7, such as polyurethane so as to enhance its stiffness performance and vibrational resistance.

Finally, it should be noted that the outer face of the envelope 13, 13A, directed towards the wheels 6, is also smooth and devoid of ribs, and thus does not constitute a trap for dust and other dirt.

What is claimed is:

1. An article of gliding equipment comprising:

a frame comprising a hermetically sealed hollow body, said hollow body comprising two lateral flanges, a pair of longitudinally opposed transversely extending end parts at opposite longitudinal ends of said lateral flanges, and an upper plate above said lateral flanges and said end parts, said upper plate being adapted to have supported thereupon an external sole of a boot;

said frame further comprising a longitudinally extending external envelope forming a lower part of said hollow body, said envelope extending transversely between said lateral flanges;

said longitudinally extending external envelope comprising a plurality of longitudinally extending successive arches;

at least one gliding member attached to said lateral flanges and extending to a position beneath said lateral flanges, said at least one gliding member being at least partially positioned within said envelope; and said at least one gliding member comprising a plurality of in-line wheels attached for rotation between said flanges, each of said wheels being positioned in a respective one of said plurality of arches.

2. An article of gliding equipment according to claim 1 wherein:

in transverse cross section, said envelope is inscribed within said lateral flanges and said upper plate.

3. An article of gliding equipment according to claim 1, wherein:

each of said two lateral flanges has a free lateral end; and in transverse cross section, said envelope is formed as an arch having free lateral ends aligned with said free lateral ends of said flanges.

4. An article of gliding equipment according to claim 1, wherein:

said envelope is nested within a structure defined by said lateral flanges, said upper plate, and said end parts.

5. An article of gliding equipment according to claim 1, wherein:

each of said wheels is attached to said lateral flanges by means of a respective rotational axle;

each of said two lateral flanges has a free lower lateral end; and each of said free lateral ends of said lateral flanges comprises a bearing for receiving said axles of said wheels.

6. An article of gliding equipment according to claim 1, wherein:

each of said wheels is attached to said lateral flanges by means of a respective rotational axle;

said envelope has a pair of transversely spaced free lower lateral ends;

each of said two lateral flanges has a free lower lateral end; and each of said free lower lateral ends of said lateral flanges and each of said free lower lateral ends of said envelope comprises a bearing for receiving said axles of said wheels.

7. An article of gliding equipment according to claim 1, wherein:

said arches have an inverted U-shape in transverse cross-section.

8. An article of gliding equipment according to claim 1, further comprising:

a foam filling said hollow body.

9. An article of gliding equipment according to claim 1, further comprising:

a foam filling said hollow body, said foam comprising a synthetic material.

10. An article of gliding equipment comprising:

a frame comprising a hermetically sealed hollow body, said hollow body comprising two lateral flanges, a pair of longitudinally opposed transversely extending end parts at opposite longitudinal ends of said lateral flanges, and an upper plate above said lateral flanges and said end parts, said upper plate being adapted to have supported thereupon an external sole of a boot;

said frame further comprising a longitudinally extending external envelope forming a lower part of said hollow body, said envelope extending transversely between said lateral flanges;

said envelope, said lateral flanges, said upper plate, and said end parts being made as a one-piece assembly; and at least one gliding member attached to said lateral flanges and extending to a position beneath said lateral flanges, said at least one gliding member being at least partially positioned within said envelope.

11. An article of gliding equipment comprising:

a frame comprising a hermetically sealed hollow body, said hollow body comprising two lateral flanges, a pair of longitudinally opposed transversely extending end parts at opposite longitudinal ends of said lateral flanges, and an upper plate above said lateral flanges and said end parts, said upper plate being adapted to have supported thereupon an external sole of a boot;

said frame further comprising a longitudinally extending external envelope forming a lower part of said hollow body, said envelope extending transversely between said lateral flanges;

said longitudinally opposed end parts of said hollow body being formed as downwardly bent portions of said upper plate, said downwardly bent portions of said upper plate being in engagement with upper surfaces of respective ends of said envelope; and at least one gliding member attached to said lateral flanges and extending to a position beneath said lateral flanges, said at least one gliding member being at least partially positioned within said envelope.

12. An article of gliding equipment comprising:

a frame comprising a hermetically sealed hollow body, said hollow body comprising two longitudinally extending lateral flanges, a longitudinally extending external envelope forming a lower part of said hollow body, said envelope extending transversely between said lateral flanges, an upper plate above said lateral flanges, forming an upper part of said hollow body, said upper part further having longitudinally opposed end parts, said end parts being bent downwardly from said upper plate to engage respective ends of said envelope, said upper plate being adapted to have supported thereupon an external sole of a boot; and said frame further comprising a longitudinally extending external envelope forming a lower part of said hollow body, said envelope extending transversely between said lateral flanges; and at least one gliding member attached to said lateral flanges and extending to a position beneath said lateral flanges, said at least one gliding member being at least partially positioned within said envelope.

13. An article of gliding equipment according to claim 12, wherein:

said at least one gliding member comprises a plurality of wheels positioned between said lateral flanges.

14. An article of gliding equipment comprising:

a frame comprising a hermetically sealed hollow body, said hollow body comprising two longitudinally extending lateral flanges, a longitudinally extending external envelope forming a lower part of said hollow body, said envelope extending transversely between said lateral flanges, an upper plate above said lateral flanges, forming an upper part of said hollow body, said upper plate being adapted to have supported thereupon an external sole of a boot;

said longitudinally extending external envelope forming a vault defining a plurality of longitudinally successive arches; and a plurality of in-line wheels attached for rotation between said flanges, each of said wheels being positioned in a respective one of said plurality of arches.

* * * * *